US005269838A

United States Patent [19]

Inoue et al.

[11] Patent Number: 5,269,838

[45] Date of Patent: Dec. 14, 1993

[54] ELECTROLESS PLATING SOLUTION AND PLATING METHOD WITH IT

[75] Inventors: Manabu Inoue, Tokyo; Mitsutada Kaneta, Ichikawa; Junko Ozawa, Chiba, all of Japan

[73] Assignee: Dipsol Chemicals Co., Ltd., Tokyo, Japan

[21] Appl. No.: 30,871

[22] Filed: Mar. 12, 1993

[30] Foreign Application Priority Data

Apr. 20, 1992 [JP] Japan ..... 4-99711

[51] Int. Cl.[5] ..... C23C 18/34; B05D 1/18

[52] U.S. Cl. ..... 106/1.22; 106/1.27; 427/438; 427/443.1; 427/98

[58] Field of Search ..... 106/1.22, 1.27; 427/438, 443.1, 98

[56] References Cited

U.S. PATENT DOCUMENTS

| | | | |
|---|---|---|---|
| 3,178,311 | 4/1965 | Cann | 106/1.22 |
| 3,340,073 | 9/1967 | Zirngiebl et al. | 106/1.22 |
| 3,615,735 | 10/1971 | Shipley, Jr. et al. | 106/1.22 |
| 3,717,482 | 2/1973 | Gulla et al. | 106/1.22 |
| 3,898,138 | 8/1975 | Clauss et al. | 205/273 |
| 4,600,609 | 7/1986 | Leever et al. | 106/1.22 |
| 4,740,277 | 4/1988 | Klos et al. | 205/246 |
| 5,147,454 | 9/1992 | Nishihara et al. | 106/1.22 |

FOREIGN PATENT DOCUMENTS

| | | |
|---|---|---|
| 0248522 | 4/1987 | European Pat. Off. . |
| 1-222064 | 9/1989 | Japan . |

OTHER PUBLICATIONS

WPI abstract Accession No. 90-279773/37 Pretreating agent for electroless plating of polyamide resin-where at least 1 specified sulphonated cpd. of formaldehyde condensate, . . . (1990).

*Primary Examiner*—Helene Klemanski

*Attorney, Agent, or Firm*—Oblon, Spivak, McClelland, Maier & Neustadt

[57] ABSTRACT

An electroless plating solution comprises nickel ion, a chelating agent for nickel ion, dimethylamine borane, one or more soluble salts of a condensate of an arylsulfonic acid with formalin, and thiodiglycolic acid, and an electroless plating method comprises the step of immersing a substrate to be plated in this electroless plating solution for sufficent time period to form a nickel or nickel alloy layer on the substrate. The electroless plating solution has a high bath stability and is capable of forming an excellent thick deposit free from pits and cracks.

16 Claims, 2 Drawing Sheets

ELECTROLESS PLATING SOLUTION AND PLATING METHOD WITH IT

BACKGROUND OF THE INVENTION

The present invention relates to an electroless Ni or Ni alloy plating solution and a method for using it. In particular, the present invention relates to an electroless plating solution suitable for forming a film having a high surface hardness on a substrate to be plated, without any heat treatment, and a plating method wherein this plating solution is used.

Known methods for plating to form a hard surface include Ni-B alloy plating method, composite plating method with boron carbide and fine diamond particles and electroless Ni-P alloy plating method. In particular, a method wherein the electroless Ni-P alloy plating is heat-treated is usually employed. However, this method has a problem that when an aluminum alloy having a low heat resistance is to be plated, the heat treatment thereof is impossible. On the contrary, the electroless Ni-B alloy plating attracts public attention, since a high surface hardness can be obtained without the heat treatment. However, this method also has a defect that the bath has a low stability.

For example, for the electroless Ni-B alloy plating, a method wherein sodium borohydride or dimethylamine borane is used is known. According to an experiment made by the inventors of the present invention wherein the plating was conducted by stirring the solution, by rocking the substrate to be plated or by barreling method, it was found that such a solution had a low stability, that Ni-B was abnormally deposited on or in the jig, barrel and plating tank and that cracks and pits were formed in the film. In addition, the continuous filtration was substantially impossible, since the abnormal deposition was accelerated. Although various methods were proposed for improving the stability of the plating solution and preventing the crack formation in the film, no method is yet practically satisfactory.

For preventing the crack formation in the film, for example, a method wherein a compound containing sulfur, nitrogen and carbon in the molecule such as L-cystine or mercaptothiazoline is added to the plating solution was proposed [Japanese Patent Unexamined Published Application (hereinafter referred to as "J.P. KOKAI") No. Hei 1-222064]. However, the effective concentration range of such a compound is quite narrow and as the concentration of the compound added becomes high, the plating is stopped unfavorably. Although it is well known that the pitting can be inhibited by adding a wettable surfactant, this effect is scarcely obtained when the plating is conducted by stirring the plating solution, by rocking of the substrate to be plated or by barrel processing.

SUMMARY OF THE INVENTION

The primary object of the present invention is to provide an electroless plating solution having a high bath stability and capable of forming an excellent film which is free from pits or cracks even when it is thick.

Another object of the present invention is to provide a plating method using the electroless plating solution.

These and other objects of the present invention will be apparent from the following description and examples.

It has been found that the above-described object can be attained by adding a soluble salt of a condensate of an arylsulfonic acid with formalin, thiodiglycolic acid and, preferably, a propynesulfonic acid salt to an electroless plating solution comprising nickel ion, chelating agent for nickel ion and reducing agent for nickel ion.

Namely, the present invention provides an electroless plating solution comprising nickel ion, a chelating agent for nickel ion, a reducing agent for nickel ion, a soluble salt of a condensate of an arylsulfonic acid with formalin, and thiodiglycolic acid.

The present invention provides an electroless plating method comprising the step of immersing a substrate to be plated in an electroless plating solution mentioned above for sufficient time period to form a nickel or nickel alloy film on the substrate.

DESCRIPTION OF THE PREFERRED EMBODIMENTS

Figure 1:
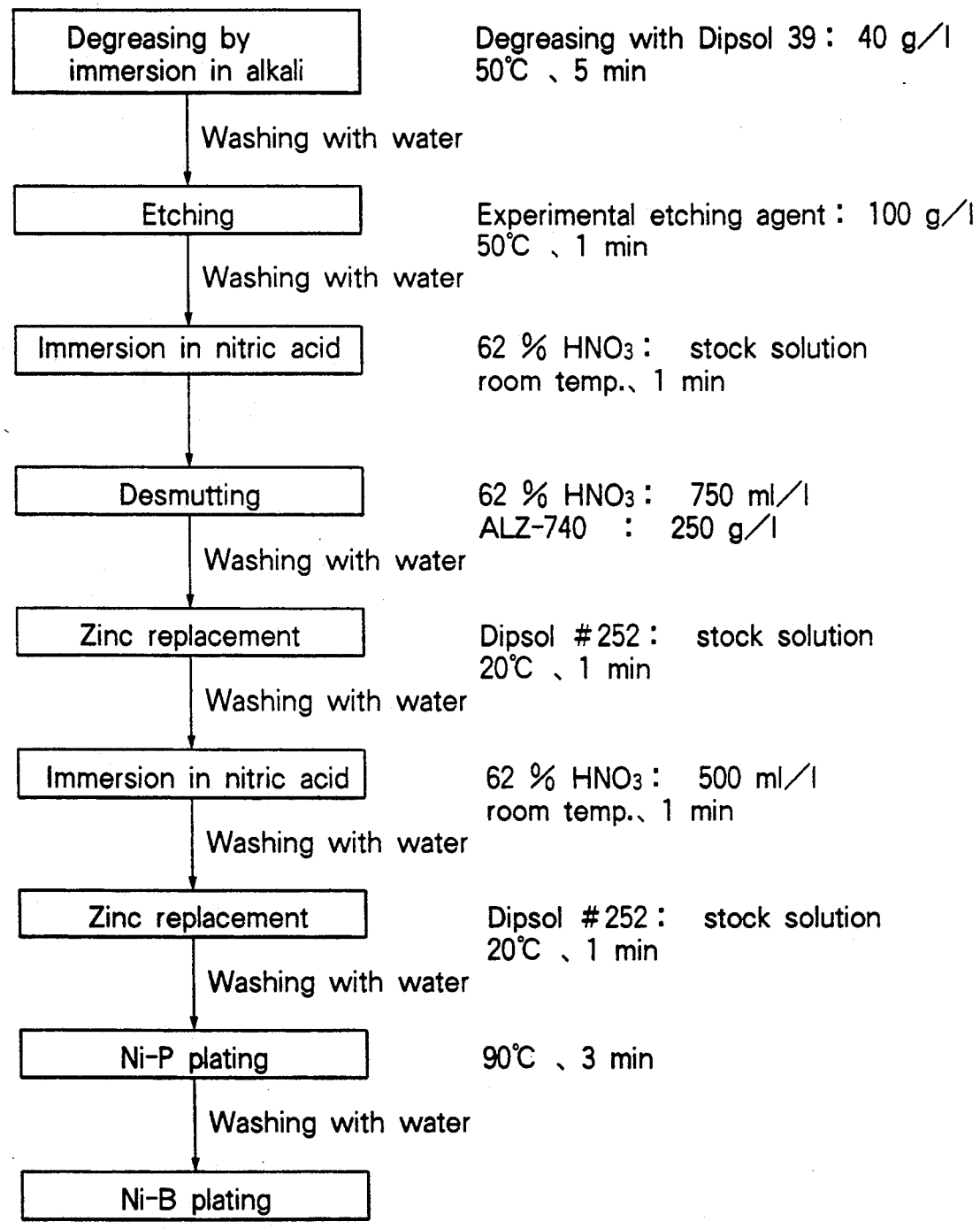
FIG. 1 is a flow sheet showing the pretreatment conducted in Example 2.

The condensate of the arylsulfonic acid with formalin has such a structure that the aryl groups are bonded to each other via a methylene group. This polymer is usually produced by adding formalin to the arylsulfonic acid or sulfonating an aryl compound with sulfuric acid and adding formalin thereto, then heating them at 50° to 60° C. so as to condensate them and completing the reaction at 80° to 100° C. However, the method for producing the polymer is not particularly limited and any polymers having such a structure that the aryl groups are bonded to each other through a methylene group are usable in the present invention. The soluble salts of the condensate are water-soluble salts produced by forming the salts of the sulfonic acid group of the condensate. The salts include, for example, Na, K, Ca and $NH_4$ salts. Preferred are linear polymers of the following formula 1:

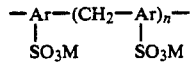

wherein Ar's which may be the same or different from each other represent a phenyl group or naphthalene group which may be substituted with an alkyl group having 1 to 16 carbon atoms, M represents Na, K, Ca or $NH_4$ and n represents an integer of at least 6.

A salt of a condensate of naphthalenesulfonic acid with formalin is the most suitable Examples of them include Demol N, Demol NL, Demol MS, Demol SNB and Demol C (products of Kao Corporation); Tamol NN 9104, Tamol NN 7519 and Tamol NNA 4109 (products of BASF); Lavelin (a product of Dai-ichi Kogyo Seiyaku Co., Ltd.); Lunox 1000 (a product of Toho Chemical Industry Co., Ltd.); and Ionet D-2 (a product of Sanyo Chemical Industries, Ltd.).

The formation of pits can be efficiently inhibited by adding one or more soluble salts of the condensate of the arylsulfonic acid and formalin. The salt of the condensate of the arylsulfonic acid and formalin is used in such an amount that the concentration thereof in the plating solution will be 5 to 500 mg/l, preferably 10 to 50 mg/l. When the concentration is below 5 mg/l, the effect is insufficient and, on the contrary, when it exceeds 500 mg/l, the formed film is heterogeneous unfavorably.

Thiodiglycolic acid used in the present invention is capable of reducing the internal stress of the film to inhibit the crack formation in the thick film, improving the stability of the solution and inhibiting the formation of a deposit on the jig and barrel. Another effect of thiodiglycolic acid is that even when the concentration thereof is high,-reduction in the velocity of the film formation is only slight and the plating is not stopped. This is a practical advantage.

Thiodiglycolic acid is used in such an amount that the concentration thereof in the plating solution will be 10 to 1000 mg/l, preferably 25 to 100 mg/l. When the concentration is below 10 mg/l, no effect is obtained and, on the contrary, when it exceeds 1000 mg/l, the hardness and the film-forming velocity are low unfavorably.

The nickel ion sources in the plating solution of the present invention include soluble nickel salts such as nickel sulfate, nickel chloride, nickel acetate and nickel sulfamate. The concentration of the soluble nickel salt in the plating solution is 0.02 to 0.2 mol/l, preferably 0.05 to 0.1 mol/l.

The chelating agents to be contained in the plating solution of the present invention include amines such as ethylenediamine, triethanolamine, tetramethylenediamine, diethylenetriamine, EDTA and NTA; pyrophosphates such as potassium pyrophosphate; ammonia; and carboxylic acids such as hydroxycarboxylic acids, aminocarboxylic acids, monocarboxylic acids and polycarboxylic acids. These chelating agents can be used either singly or in the form of a combination of two or more of them. It is desirable to select the most stable chelating agent depending on the reducing agent used and pH of the bath. The chelating agents include acids such as glycolic acid, malic acid, citric acid, tartaric acid, gluconic acid, diglycolic acid, glycine, aspartic acid, alanine, serine, acetic acid, succinic acid, propionic acid and malonic acid and alkali metal salts and ammonium salts of them.

The total amount of these chelating agents is 0.05 to 2.0 mol/l, preferably 0.2 to 0.5 mol/l. Some of the chelating agents act also as a buffering agent. The optimum bath composition is selected taking the properties of them into consideration.

The reducing agents to be contained in the plating solution of the present invention include hypophosphites such as sodium hypophosphite; alkali metal borohydrides such as sodium borohydride; soluble borane compounds such as dimethylamine borane and trimethylamine borane; soluble borane compounds usable also as a solvent such as diethylamine borane and isopropylamine borane; and hydrazine. Among them, the soluble borane compounds are preferred. Dimethylamine borane is particularly preferred. When the hypophosphite is used as the reducing agent, the plating solution of the present invention is an electroless Ni-P plating solution and when the soluble borane compound is used, it is an electroless Ni-B plating solution. When hydrazine is used as the reducing agent, the plating solution of the present invention is an electroless Ni plating solution.

The amount of the reducing agent is such that the concentration thereof in the plating solution will be 0.01 to 0.1 mol/l, preferably 0.02 to 0.07 mol/l.

The plating solution of the present invention can contain known metallic stabilizers such as lead ion, cadmium ion, bismuth ion, antimony ion, thallium ion, mercury ion, arsenic ion, molybdic acid ion, tungstic acid ion, vanadic acid ion, halogenic acid ions, thiocyanic acid ion and tellurous acid ion. Among them, particularly preferred are lead ion, zinc ion and molybdic acid ion. The upper limit of the concentration of these metallic stabilizers is such that the deposition velocity is not lowered. In particular, the upper limits of lead ion, zinc ion and molybdic acid ion are 1 to 4 mg/l, 2 to 100 mg/l and 10 to 150 mg/l, respectively. These metallic stabilizers are usable in the form of salts thereof such as nitrates, ammonium salts and alkali metal salts thereof.

The amount of the propynesulfonate desirably added to the plating solution of the present invention is such that the concentration thereof in the plating solution will be 10 to 1,000 mg/l, preferably 40 to 250 mg/l. When the concentration thereof in the plating solution is below 10 mg/l, the effect is insufficient and, on the contrary, when it exceeds 1,000 mg/l, the deposition velocity is unfavorably low. When the propynesulfonate is added, the deposition velocity of the plating metal is controlled to inhibit the deposition of the metal on the jig and barrel. Although acetylene compounds, in addition to the propynesulfonate, had the effect of inhibiting the deposition on the jig and barrel, they could not be used, since the formation of pits was serious.

The plating solution of the present invention may further contain a known anionic surfactant, boric acid, an unsaturated carboxylic acid salt, an unsaturated sulfonic acid salt, sulfonimide or sulfonamide so as to reduce the internal stress and to improve the appearance.

The order of the addition of the components of the plating solution of the present invention is not particularly limited. Thiodiglycolic acid can be used in the form of either the free acid or a salt thereof with a cation usable herein as the counter ion.

The present invention also relates to a plating method wherein the electroless plating solution is used. The description will be made on this method.

In the plating method of the present invention, the bath temperature is 50° to 90° C., preferably 60° to 65° C. When the bath temperature is elevated, the deposition velocity increases but the bath stability loweres the pH ranges from 3 to 14, preferably 6.0 to 7.0. The pH can be higher with ammonia or an alkali hydroxide such as NaOH or KOH, and lowered with an acid such as sulfuric acid or hydrochloric acid. The bath temperature and pH are determined in consideration of the relationship between the bath stability and the deposition velocity, since when pH is high, the deposition velocity increases and the bath stability loweres.

In the plating process, the substrate to be plated is pretreated by an ordinary method and then plated under stirring or without stirring, by rocking the substrate or by barelling. The immersion time of the substrate to be plated can be suitably determined depending on the thickness of the coating film to be formed and is usually several minutes to several hours. The coating film thickness is variable over a wide range of usually 5 to 200 μm, preferably 10 to 50 μm. The substrate to be plated can be a metal, resin, ceramics or glass. The metallic materials include, for example, aluminum, aluminum alloys (such as ADC 12), copper, copper alloys (such as brass and beryllium copper), iron, stainless steel, nickel, cobalt, titanium, magnesium and magnesium alloys. The resin materials include, for example, plastics such as ABS, polyimides, acrylates, nylons, polyethylenes and polypropylenes. When a semiconductor is to be plated, it must be sensitized and activated with a tin chloride or palladium chloride solution as in an ordinary electroless plating method.

When an aluminum, aluminum alloy, copper or copper alloy material which necessitates the zinc replacement is used, it is desirable to conduct an electroless Ni-P plating as a pretretment prior to the electroless Ni-B alloy plating so that the contamination of the plating solution with zinc or copper is prevented. The aluminum alloy is preferred from the viewpoint of the improvement of the adhesion.

In case the plating solution of the present invention is used, it can be filtered during the plating in order to prevent roughness of the coating film. Though the filtration can be conducted in any stage, it is particularly convenient to conduct it in the plating step. The plating solution can be filtered with, for example, a cartridge filter.

The plating solution of the present invention is usable for a long time without replacing it by keeping the composition of the solution constant by using a suitable replenisher.

The following Examples will further illustrate the present invention.

EXAMPLES

Example 1

SPCC steel sheets (thickness: 0.3 mm, 50 mm×20 mm) were degreased and electrolytically cleaned with commercially available degreasing agent and electrolytic detergent (Degreaser 39 and NC-20; Dipsol Chemicals Co., Ltd.) and then activated with 3.5 % hydrochloric acid. After washing with water (rinse with water), the sheets were immersed in a plating solution having a composition given in Table 1 or 2 and rocked at a rate of 220 cm/min at a bath temperature of 63° C. to conduct the electroless Ni-B alloy plating. Thus, a smooth, glossy coating film having neither pits nor cracks was obtained from all the compositions under all the conditions. The hardness of the plated sheets was 800 to 900 Hv. No defect in the adhesion was recognized by a heat shock test (comprising heating at 250° C. for 1 hour followed by immersion in cold water) and 180° bending test. The results and the deposition velocities thus obtained are listed in Table 3.

TABLE 1

| Bath component (g/l) | 1 | 2 | 3 | 4 | 5 |
|---|---|---|---|---|---|
| $NiSO_4.6H_2O$ | 27 | 18 | 27 | 27 | 27 |
| Dimethylamine borane | 2 | 2 | 3 | 3 | 3 |
| Glycolic acid | 15 | 15 | 15 | — | — |
| Malic acid | — | — | — | 10 | — |
| Malonic acid | — | — | — | — | 5 |
| Citric acid | — | — | — | — | 5 |
| Glycine | — | 7.5 | 4 | — | 7.5 |
| Ammonium acetate | 20 | 10 | 7.5 | 20 | — |
| Condensate A | 0.01*1 | — | 0.01*2 | — | 0.01 |
| Condensate B | — | 0.02*4 | — | — | — |
| Condensate C | — | — | — | 0.01*5 | — |
| Sodium propynesulfonate | — | — | 0.2 | 0.04 | 0.01 |
| Thiodiglycolic acid | 0.05 | 0.05 | 0.05 | 0.025 | 0.1 |
| Lead nitrate | — | 0.0024 | — | — | — |
| Ammonium molybdate | — | — | 0.05 | — | — |
| Zinc sulfate | — | — | — | 0.025 | — |
| Sodium tungstate | — | — | — | — | 0.02 |
| pH | 6.0 | 6.0 | 6.0 | 6.5 | 6.5 |

Condensate A: Sodium salt of naphthalenesulfonic acid/formalin condensate
Condensate B: Ammonium salt of naphthalenesulfonic acid/formalin condensate
Condensate C: Sodium salt of arylsulfonic acid/formalin condensate
*1Trade name: Demol N,
*2Trade name: Demol NL,
*3Trade name: Lavelin
*4Trade name: Tamol NNA 4109
*5Trade name: Demol SNB

TABLE 2

(continued from Table 1)

| Bath composition (g/l) | 6 | 7 | 8 | 9 | 10 |
|---|---|---|---|---|---|
| $NiSO_4.6H_2O$ | 27 | 22.5 | 22.5 | 22.5 | 27.0 |
| Dimethylamine borane | 3 | 2 | 2 | 2 | 3 |
| Glycolic acid | 15 | 15 | 7.5 | 15 | 15 |
| Aspartic acid | 4 | — | — | — | — |
| Gluconic acid | — | — | 15 | — | — |
| Glycine | — | 7.5 | 7.5 | 5 | 7.5 |
| Ammonium acetate | 10 | 20 | 20 | 7.5 | 20 |
| Condensate A | 0.05*1 | 0.01*6 | 0.02*1 | 0.01*1 | 0.01 |
| Sodium propynesulfonate | 0.1 | 0.1 | 0.1 | 0.1 | 0.1 |
| Thiodiglycolic acid | 0.025 | 0.05 | 0.05 | 0.1 | 0.05 |
| Lead nitrate | — | 0.0032 | 0.0032 | 0.0032 | 0.0032 |
| Potassium vanadate | 0.02 | — | — | — | — |
| pH | 6.5 | 8.0 | 7.0 | 6.3 | 9.0 |

*6Trade name: Ionet D-2

TABLE 3

| No. | 1 | 2 | 3 | 4 | 5 | 6 | 7 | 8 | 9 | 10 |
|---|---|---|---|---|---|---|---|---|---|---|
| Film thickness (μm) | 30 | 30 | 30 | 30 | 30 | 30 | 30 | 30 | 30 | 30 |
| Hardness (Hv) | 860 | 840 | 880 | 850 | 800 | 870 | 820 | 830 | 820 | 800 |
| Appearance: | | | | | | | | | | |
| Pit formation | no | no | no | no | no | no | no | no | no | no |
| Crack formation | no | no | no | no | no | no | no | no | no | no |
| Deposition rate (μm/h) | 6.0 | 6.2 | 5.0 | 4.5 | 5.0 | 5.0 | 5.5 | 5.0 | 6.1 | 3.0 |
| Crack formation by heat shock test | no | no | no | no | no | no | no | no | no | no |
| Peeling by bending test | no | no | no | no | no | no | no | no | no | no |

Example 2

A die-cast aluminum plate to be plated was pretreated by the steps shown in FIG. 1. Then it was washed with water and subjected to the electroless Ni-B alloy plating by the barreling method with a bath having a composition given in Table 4 under the plating conditions given in Table 4 to obtain a glossy, smooth Ni-B alloy plating film having a thickness of 30 μm and free from pitting or cracks. The film had a Vickers hardness of 820 Hv and surface roughness of 0.2 μm (Ra value: determined with a surface roughness tester mfd. by Kosaka Ltd.). The surface roughness of the plate before the plating was 0.6 to 0.8 μm. In both heat shock test (wherein the substrate to be plated was heated at 200° C. for 1 hour and then immersed in cold water) and bending test, no problem was found in the adhesion. No deposition of Ni-B on the barrel or plating vessel wall was found.

Example 3

The electroless Ni-B alloy plating was conducted by the barreling in the same manner as that of Example 2 except that the bath composition and plating conditions were altered as shown in Table 4. As a result, a glossy, smooth Ni-B alloy deposit having a thickness of 35 μm and free from pitting and cracks was obtained. The deposit had a vickers hardness of 840 Hv and surface roughness of 0.2 μm. The surface roughness of the plate before the plating was 0.6 to 0.8 μm. In both heat shock test and bending test, no problem was found in the adhesion.

Example 4

Figure 2:
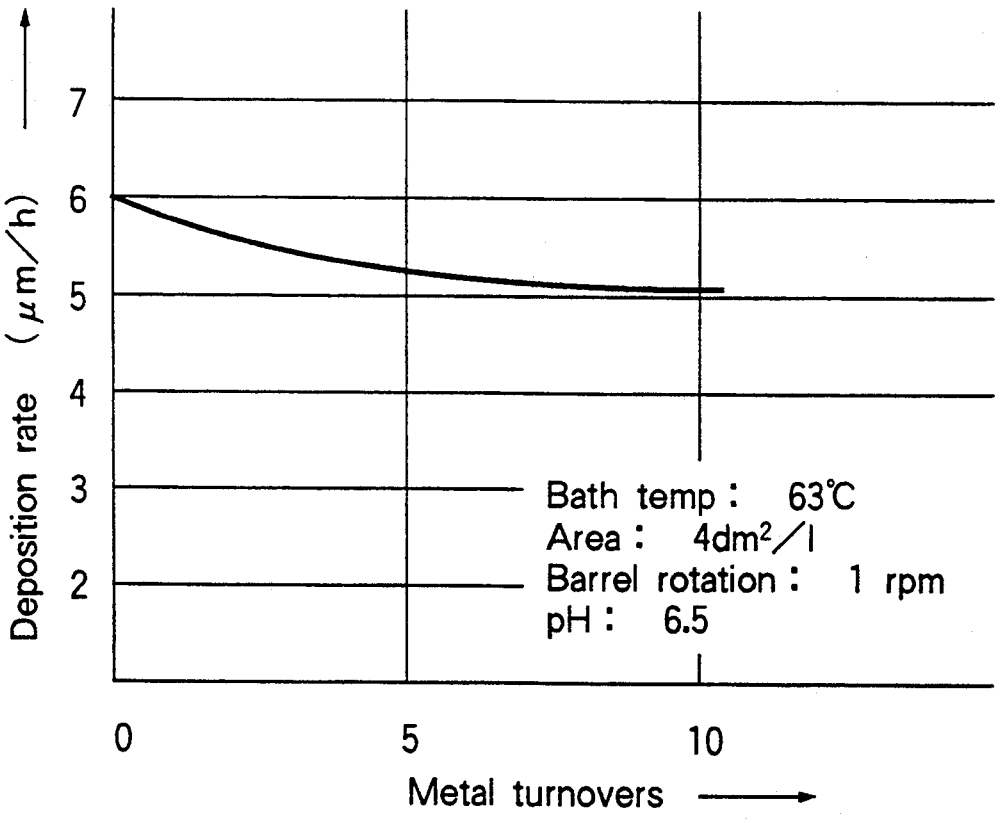
FIG. 2 is a graph showing the stability of the bath of the present invention, wherein the ordinates indicate the deposition rate and the abscissae indicates the number of turns.

Steel balls having a diameter of 4 mm were used as the substrate to be plated. They were pretreated in the same manner as that of Example 1. The electroless Ni-B alloy plating was conducted by barreling using a bath having a composition given in Table 4. After conducting the plating (10 metal turnovers) while the components were replenished so as to keep the bath composition constant, the plating velocity was not significantly lowered and the bath stability was still excellent. The plating film thus formed had the intended properties. The results are given in FIG. 2 and Table 5.

TABLE 4

| | Example 2 | Example 3 | Example 4 |
|---|---|---|---|
| Bath component (g/l) | | | |
| $NiSO_4.6H_2O$ | 22.5 | 0 | 22.5 |
| $NiCl.6H_2O$ | 0 | 20.0 | 0 |
| Dimethylamine borane | 2.0 | 2.0 | 2.0 |
| Glycolic acid | 15.0 | 15.0 | 17.0 |
| Glycine | 4.0 | 5.0 | 4.0 |
| Acetic acid | 7.0 | 0 | 6.0 |
| Ammonium acetate | 0 | 10.0 | 0 |
| Sodium salt of naphthalenesulfonic acid/formalin condensate*1 | 0.01 | 0.01 | 0.01 |
| Sodium propynesulfonate | 0.10 | 0.15 | 0.15 |
| Thiodiglycolic acid | 0.05 | 0.05 | 0.05 |
| Lead nitrate | 0.003 | 0.003 | 0.003 |
| pH | 7.0 | 6.3 | 6.5 |
| pH adjustor | NaOH | $NH_4OH$ | $NH_4OH$ |
| Plating conditions | | | |
| Bath temp. (°C.) | 63 | 63 | 65 |
| Barrel rotation rate (r.p.m.) | 1 | 1 | 1 |
| Plating time (h) | 4.5 | 6 | *2 |
| Quantity of bath (l) | 6 | 6 | 6 |
| Amount of deposit ($dm^2/l$) | 1 | 1 | 4 |
| Continuous filtration (flow rate: l/min) | 30 | 30 | 30 |

*1Trade name: Demol (mfd. by Kao Corporation)
*2The substrate to be plated was exchanged each time after formation of the film having a thickness or 30 μm and the appearence thereof was observed.

TABLE 5

| | Metal turnovers | |
|---|---|---|
| | 0 | 10 |
| Hardness (Hv) | 840 | 840 |
| Surface roughness (μm) | 0.22 | 0.2 |
| Deposition rate (μ/h) | 6.0 | 5.1 |
| Adhesion | good | good |
| Appearance | slight pitting | slight pitting |
| Gloss | 860 | 860 |
| Film thickness (μm) | 30 | 30 |
| Boron content (wt. %) | 0.5 | 0.5 |

Comparative Example 1

Electroless Ni-B alloy plating was conducted by using the same substrate in the same manner as those of Example 1 except that the bath composition (1) in Table 6 was used and one of the divalent sulfur compound Nos. 11 to 18 in Table 7 was added. In all the cases, cracks were formed or the plating was stopped. The results are given in Nos. 11 to 18 in Table 7.

Comparative Example 2

Electroless Ni-B alloy plating was conducted by using the same substrate in the same manner as those of Example 1 except that the bath composition (2) in Table 6 was used and one of known anionic surfactant Nos. 19 to 27 in Table 7 was added. The results are given in Nos. 19 to 27 in Table 7. In all the cases, the pitting was serious.

Comparative Example 3

Electroless Ni-B alloy plating was conducted by barreling in the same manner as that of Example 2 except that the bath composition (3) in Table 6 was used. A large quantity of Ni-B was deposited on the walls of the barrel, filter and plating vessel to make the continuation of the plating impossible. The plating film observed after the stop of the plating was quite rough and had numerous pits, though no cracks were found.

TABLE 6

| | Comp. Ex. 1 | Comp. Ex. 2 | Comp. Ex. 3 |
|---|---|---|---|
| Bath component (g/l) | (1) | (2) | (3) |
| $NiSO_4.6H_2O$ | 27.0 | 18.0 | 22.5 |
| $NiCl.6H_2O$ | 0 | 0 | 0 |
| Dimethylamine borane | 3.0 | 2.0 | 2.0 |
| Glycolic acid | 15.0 | 15.0 | 15.0 |
| Glycine | 5.0 | 7.5 | 4.0 |
| Acetic acid | 0 | 0 | 0 |
| Ammonium acetate | 7.5 | 10.0 | 10.0 |
| Sodium salt of naphthalene-sulfonic acid/formalin condensate*1 | 10.0 | 0 | 0 |
| Thiodiglycolic acid | 0 | 50.0 | 50.0 |
| Lead nitrate | 3.2 | 3.2 | 3.2 |
| pH | 6.3 | 6.3 | 6.3 |
| pH adjustor | $NH_4OH$ | $NH_4OH$ | $NH_4OH$ |
| Plating conditions | | | |
| Bath temp. (°C.) | 63 | 63 | 63 |
| Barrel rotation rate (rpm) | — | — | 1 |
| Plating time (h) | | | 2*2 |
| Quantity of bath (l) | 1 | 1 | 6 |
| Amount of plating ($dm^2/l$) | 0.2 | 0.2 | 0.5 |
| Continuous filtration (l/min) | none | none | 30 |

*1Trade name: Demol (mfd. by Kao Corporation)
*2Continuation of plating was impossible.

TABLE 7

| No. | Additive (mg/l) | Deposition Film rate (μm/h) | Deposition Film thickness (μm) | Pit formation | Crack |
|---|---|---|---|---|---|
| 11 | None | 13.5 | 30 | yes | yes |
| 12 | 3,3'-Thiodipropionic acid, 50 | 6.0 | 30 | yes | yes |
| 13 | Ethylene thiourea, 10 | stopped | 0 | — | — |
| 14 | 2-Mercaptothiazoline, 10 | stopped | 0 | — | — |
| 15 | L-cystine, 25 | stopped | 0 | — | — |
| 16 | β-Thiodiglycol, 100 | 4.5 | 30 | yes | yes |
| 17 | Thioglycolic acid, 15 | stopped | 0 | — | — |
| 18 | DL-Methionine, 30 | 5.0 | 30 | yes | yes |
| 19 | None | 6.0 | 30 | yes | no |
| 20 | Sodium dodecylbenzene-sulfonate, 10 | 6.0 | 30 | yes | no |
| 21 | Sodium laurylsulfate, 10 | 6.0 | 30 | yes | no |
| 22 | Triethanolamine laurylsulfate, 10 | 6.0 | 30 | yes | no |
| 23 | Potassium fluoroalkyl-sulfate (FC-98), 10 | 6.0 | 30 | yes | no |
| 24 | Sodium dioctyl sulfo-succinate, 10 | 6.0 | 30 | yes | no |
| 25 | Sodium polyoxyethylene lauryl ether sulfate, 10 | 10.0 | 12.3 | yes | yes |
| 26 | Sodium polyoxyethylene nonylpheny ether sulfate, 10 | 8.0 | 15.0 | yes | yes |
| 27 | Potassium polyoxyethylene lauryl ether phosphate 10 | 13.0 | 15.0 | yes | yes |

According to the present invention, a film having a high surface hardness can be easily obtained without necessitating a heat treatment of the substrate to be plated. In addition, since the mass production of the plating films with a long barrel by continuous filtration is possible, the smooth deposit having a high hardness can be efficiently obtained. When a soluble borane compound is used as a reducing agent, an Ni-B deposit having a high purity and only a low boron content can be stably obtained. Thus the present invention can be employed in electronic industry, too.

What is claimed is:

1. An electroless plating solution comprising nickel ion, a chelating agent for nickel ion, a reducing agent for nickel ion, a soluble salt of a condensate of an arylsulfonic acid with formalin, and thiodiglycolic acid.

2. The electroless plating solution of claim 1 wherein the reducing agent for nickel ion is a soluble borane compound.

3. The electroless plating solution of claim 2 wherein the soluble borane compound is dimethylamine borane.

4. The electroless plating solution of claim 1 wherein the soluble salt of a condensate of an arylsulfonic acid with formalin is a soluble salt of arylsulfonic acid/formalin condensate.

5. The electroless plating solution of claim 1 wherein it further contains a propynesulfonate.

6. The electroless plating solution of claim 1 wherein it comprises 0.02 to 0.2 mol/l of soluble nickel salt for providing nickel ion, 0.05 to 2.0 mol/l of the chelating agent, 0.01 to 0.1 mol/l of the reducing agent, 5 to 500 mg/l of the soluble salt of a condensate of an arylsulfonic acid with formalin, 10 to 1000 mg/l of thiodiglycolic acid and a balance of water.

7. The electroless plating solution of claim 6 wherein the reducing agent for nickel ion is a soluble borane compound.

8. The electroless plating solution of claim 6 wherein the soluble salt of a condensate of an arylsulfonic acid with formalin is a soluble salt of arylsulfonic acid/formalin condensate.

9. The electroless plating solution of claim 6 wherein it further contains 10 to 1000 mg/l of a propynesulfonate.

10. The electroless plating solution of claim 6 wherein pH of the electroless plating solution is 3 to 14.

11. An electroless plating method comprising the step of immersing a substrate to be plated in an electroless plating solution comprising nickel ion, a chelating agent for nickel ion, a reducing agent for nickel ion, a soluble salt of a condensate of an arylsulfonic acid with formalin, and thiodiglycolic acid for sufficient time period to form a nickel or nickel alloy film having a thickness of 5 to 200 μm on the substrate.

12. The electroless plating method of claim 11 wherein the immersing is conducted at a temperature of 50° to 90° C.

13. The electroless plating method of claim 11 wherein the immersing is conducted while the substrate is rocking or while barrel processing is carried out.

14. The electroless plating method of claim 11 wherein the immersing is conducted while the electroless plating solution is subjected to continuous filtration.

15. The electroless plating method of claim 11 wherein the substrate is a substrate which has been subjected to an electroless plating with Ni-P alloy.

16. The electroless plating method of claim 11 wherein the electroless plating solution comprises 0.02 to 0.2 mol/l of soluble nickel salt for providing nickel ion, 0.05 to 2.0 mol/l of the chelating agent, 0.01 to 0.1 mol/l of the reducing agent, 5 to 500 mg/l of the soluble salt of a condensate of an arylsulfonic acid with formalin, 10 to 1000 mg/l of thiodiglycolic acid and a balance of water.

* * * * *